US005411406A

United States Patent [19]

Kondo

[11] Patent Number: 5,411,406

[45] Date of Patent: May 2, 1995

[54] ELECTRICAL CONNECTOR REQUIRING LOW INSERTION FORCE

[75] Inventor: Hiroki Kondo, Shizuoka, Japan

[73] Assignee: Yazaki Corporation, Japan

[21] Appl. No.: 157,323

[22] Filed: Nov. 26, 1993

[30] Foreign Application Priority Data

Nov. 30, 1992 [JP] Japan ..... 4-320589

[51] Int. Cl.[6] ..... H01R 13/15

[52] U.S. Cl. ..... 439/263; 439/259; 439/352

[58] Field of Search ..... 439/259, 260, 261, 262, 439/263, 265, 352, 264; 200/51.09, 51.10

[56] References Cited

U.S. PATENT DOCUMENTS 3,891,289 6/1975 Hanke ..... 439/263
4,627,681 12/1986 Hong ..... 439/263

FOREIGN PATENT DOCUMENTS 55-012563 1/1980 Japan .
58-044776 3/1983 Japan .
4033277 2/1992 Japan ..... 439/261

*Primary Examiner*—Gary F. Paumen
*Assistant Examiner*—Hien D. Vu
*Attorney, Agent, or Firm*—Wigman, Cohen, Leitner & Myers

[57] ABSTRACT

An electrical connector requiring low insertion force includes a connector housing having a terminal accommodating chamber; and a first terminal contained in the terminal accommodating chamber for engaging a second terminal. The first terminal has an elastic contact portion which is deflected towards one side having a slide-contact with the second terminal when the latter is inserted into the first terminal. The connector housing has a partition wall defining a flexure accepting space which allows the elastic contact portion to be deflected and a guide groove communicated with the flexure accepting space. The electrical connector further includes an urging member inserted into the guide groove through the flexure accepting space to urge the elastic contact portion towards the second terminal.

7 Claims, 5 Drawing Sheets

ELECTRICAL CONNECTOR REQUIRING LOW INSERTION FORCE

BACKGROUND OF THE INVENTION

This invention relates to an electrical connector requiring low insertion force and, in particular, to an electrical connector terminal that is adapted to mate with a mating connector terminal with low force.

Such an electrical connector requiring low insertion force can be found in the publication, Japanese Utility Model Laid Open No. 12563/1980. The connector comprises connector housings engaged with each other to position an inner pair of contact pieces against an outer pair of contact pieces. For this to occur a rotation lever is rotated allowing a cam body to make $\frac{1}{4}$ revolutions. The cam body thus makes contact with the inner pair of contact pieces, deforming them outward, forcing a connection with the outer contact pieces. Through this connection an electrical path is created.

In the electrical connector described above, the inner pair of contact pieces do not slide on the outer pair of contact pieces when creating an electrical connection. Accordingly, there is no sliding resistance or friction between the contact pieces and thus little insertion force is required (low insertion force) to mate the terminals. However, this mating operation is useless against oxide films which can form on the back surface of the contact pieces. The reason being, it is impossible to strip such oxide films during engagement of the contact pieces because the contact pieces are not rubbed against each other. The presence of oxide films or adhesions such as dust on the surface of the contact pieces would thus tend to make electrical connections unreliable.

To alleviate this problem, some connectors comprise contact pieces which slide against each other when making an electrical connection. This type of connector has, however, a disadvantage of requiring high insertion force.

SUMMARY OF THE INVENTION

Taking the above mentioned problems into consideration, an object of the present invention is to provide an electrical connector which requires a low insertion force and also enables the contact pieces to rub against each other, thereby increasing the reliability of the electrical connections.

Another object of the present invention is to provide an electrical connector requiring a low insertion force while ensuring a desired contact pressure and good insertion performance.

In order to overcome the above mentioned objects, the present invention provides an electrical connector requiring a low insertion force comprising a connector housing having a terminal accommodating chamber; and a first terminal contained in the terminal accommodating chamber for engaging a second terminal, the first terminal having an elastic contact portion that is deflected towards one side having a slide-contact with the second terminal when the latter is inserted into the first terminal, wherein the connector housing has a wall to separate a flexure accepting space that allows the elastic contact portion to be bent from a guide groove communicated with the flexure accepting space, the electrical connector further comprises an urging member inserted into the guide groove through the flexure accepting space to urge the elastic contact portion towards the second terminal.

To use the electrical connector having the above mentioned structure, the connector housing is first engaged with a mating connector to insert the second terminal of the mating connector into the first terminal in the terminal accommodating chamber. In this event, the second terminal slides on and contacts with the elastic contact portion of the first terminal, thereby oxide films and dust on the contact surface are removed therefrom. The elastic contact portion is deflected and shifted towards one side when the second terminal is inserted into the first terminal. In this event, the elastic contact portion is allowed to be freely deflected into the flexure accepting space defined beside the elastic contact portion. This means that the elastic contact portion shifts into the flexure accepting space without causing high insertion force. Accordingly, repulsion caused by the elastic contact portion is less affected on insertion operation even when the connector has many terminals and thus the second terminals are inserted readily into the respective first terminals.

Subsequently, the urging member is inserted into the guide groove. This insertion of the urging member forces the elastic contact portion towards the other side, which causes the elastic contact portion to contact strongly with the second terminal. As a result, the second terminal contacts with the corresponding elastic contact portion at a desired contact pressure.

In the preferred aspect of the present invention, the connector housing further comprises a locking arm that is deflected before completion of engagement to mate the connector housing with the mating connector and that is restored on completion of engagement to provide a locking state, the urging member serves to prevent the locking arm from being deflected when it is inserted into the guide groove.

In the preferred aspect having the above mentioned structure, the locking arm is deflected when the engagement is not completed, thus preventing the urging member from being inserted into the guide groove. This indicates that the connector housing is not completely mated with a mating connector.

These and other objects and features of the present invention will become more fully apparent from the following description and appended claims taken in conjunction with the accompanying drawing.

BRIEF DESCRIPTION OF THE DRAWING

FIG. 8 is a characteristic diagram for use in describing differences in operation between the comparative example and the embodiment of the present invention, in which

DESCRIPTION OF THE PREFERRED EMBODIMENT

Figure 1:
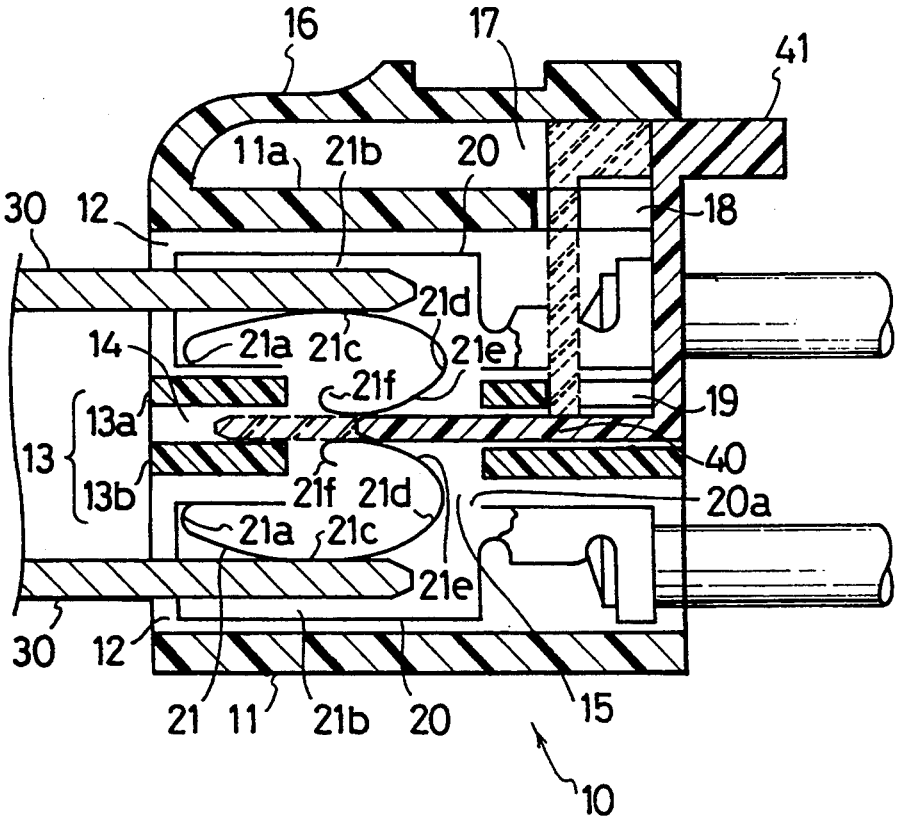
FIG. 1 is a side sectional view of an embodiment of the present invention.

A embodiment of the present invention is now described with reference to the drawing. Throughout the following detailed description, numerals refer to the corresponding elements in all figures of the drawing.

Figure 2:
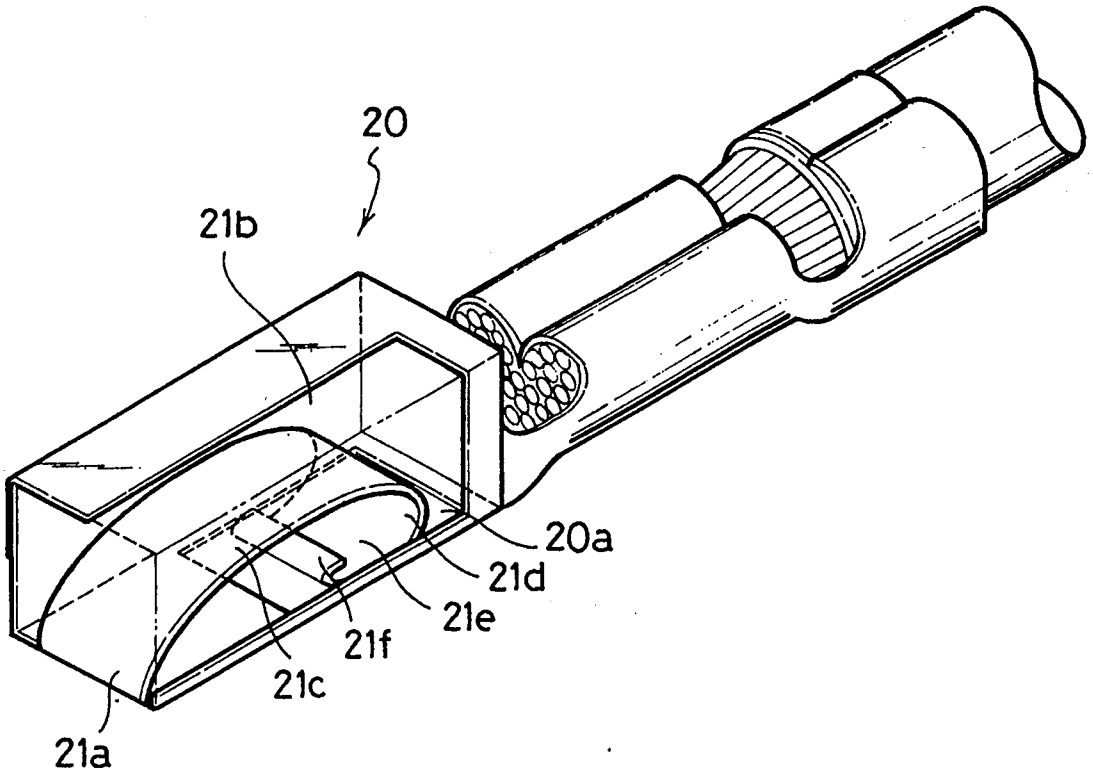
FIG. 2 is a perspective view showing a female terminal according to the embodiment of the present invention.
Figure 3:
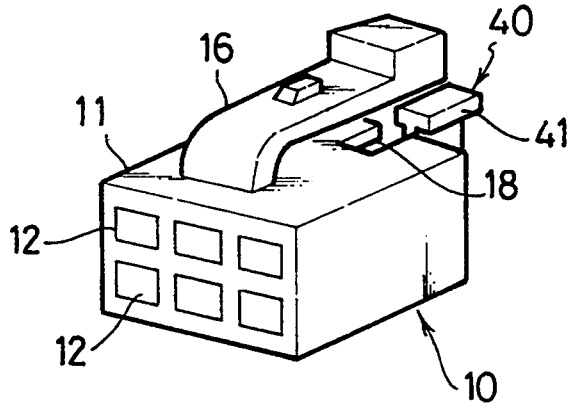
FIG. 3 is a perspective view of the embodiment of the present invention, the perspective is from a diagonally forward thereof.

In FIGS. 1 through 3, an electrical connector 10 comprises a connector housing 11 having multiple terminal accommodating chambers 12. The terminal accommodating chambers 12 are banked up, i.e., arranged into an upper bank of sockets and a lower bank of sockets. These socket banks are separated by a partition 13 composed of two walls 13*a* and 13*b*. A guide groove 14 is defined between the walls 13*a* and 13*b*. The central portion of the partition 13 along the longitudinal direction has a gap to form a flexure accepting space 15 described below.

A locking arm 16 is provided on an external surface of an upper wall 11*a* of the connector housing 11. The locking arm 16 has a front portion cantilevered by the connector housing 11 and extends backward and parallel along the upper wall 11*a*, and is freely deflected downward. When the connector 10 according to the present invention is engaging with the mating connector, the locking arm 16 deflects downward and is restored on completion of engagement to provide a locking state. A flexure accepting space 17 is defined between the locking arm 16 and the upper wall 11*a* of the connector housing 11 to enable sufficient bending of the locking arm 16.

Female terminals 20 are inserted from the rear of the respective terminal accommodating chambers 12 and secured. Each female terminal 20 is provided with an elastic contact piece 21 that slides against a corresponding contact piece from a mating male terminal 30 when the latter is inserted into a female terminal 20. The elastic contact piece 21 has, as best shown in FIG. 2, a cantilevered front end which extends backwards. It is bent entirely and formed into an approximate U-shape or C-shape. The elastic contact piece 21 comprises a first curved portion 21*c*, a U-shaped turning portion 21*d*, a second curved portion 21*e* and an up-turned edge portion 21*f*. The first curved portion 21*c* is extended backward from a supporting portion 21*a* such that it is shaped into a convex shape in the direction towards a male terminal 80. The U-shaped turning portion 21*d* flows from first curved portion 21*c*. The second curved portion 21*e* is extended forward from the turning portion 21*d* such that it is bent into a convex shape towards the partition 13. The up-turned edge portion 21*f* flows from the second curved portion 21*e*. In addition, an opening 20*a* is formed in the bottom of the female terminal 20 from which the second curved portion 21*e* and the up-turned edge portion 21*f* of the elastic contact piece 21 is projected outward.

The partition 13 has a gap at the sides of the elastic contact pieces 21 to provide the flexure accepting space 15 adjacent to the opening 20*a*. The female terminals 20 are inserted into the upper and the lower banks of the terminal accommodating chambers 12 with the flexible portions opposing each other. When this is done, the female terminals 20 are so arranged that the second curved portion 21*e* is positioned into the flexure accepting space 15.

Figure 4:
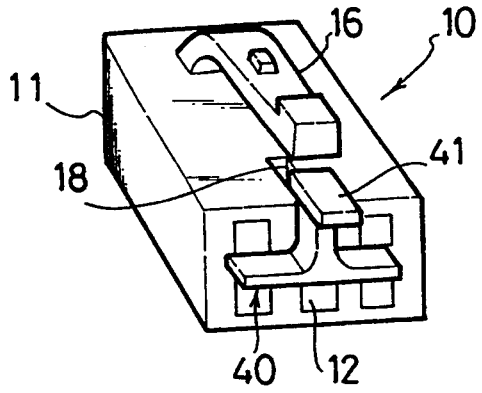
FIG. 4 is a perspective view of the embodiment of the present invention, the perspective is from a diagonally backward thereof.
Figure 5:
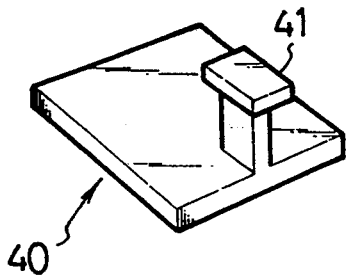
FIG. 5 is a perspective view of a slider according to the embodiment of the present invention, the perspective from a diagonally backward position.

An urging member (slider) 40 is inserted into the guide groove 14 defined between two walls 13*a* and 13*b* composing the partition 13. The slider 40 can move in the forward and backward directions. The slider 40 is formed into a plate as shown in FIGS. 4 and 5 and is provided with an operation portion 41 at the rear end. To move this operational portion 41 into receiving slits 18 and 19 (see FIG. 1) are formed in the connector housing 11.

Operation is now described below.

To use the electrical connector 10, first, the male terminals 30 are inserted into their respective female terminal 20 by connecting the mating connector to the electrical connector 10. During insertion, each of the male terminals 30 slides against and makes electrical contact with the first curved portion 21*c* of the elastic contact piece 21. During this operation, male terminal 30 applies a force on the elastic contact piece 21, deflecting it with the supporting point 21*a* as a fulcrum. This slide contact contributes to the removal of the oxide films on the contact surface. The deforming elastic contact piece 21 is located in the flexure accepting space 15, so that the deformation can proceed uninhibited. In other words, the elastic contact piece 21 bends freely into the space 15 (towards the one side). As a result, a low insertion resistance is generated and it is possible to easily insert the male terminals 30 into the respective female terminals 20 without a large amount of opposition from the elastic contact piece 21 even when the connector has many terminals.

Next, the slider 40 is inserted into the connector 10. The slider 40 moves across the flexure accepting space 15 as indicated by the broken line in FIG. 1. The slider 40 then slides against the second curved portion 21*e* of the elastic contact piece 21 that has already been shifted into the flexure accepting space 15. As the slider 40 is inserted into the slide groove 14, the elastic contact piece 21 is forced back towards the male terminal 30 (away from the slider 40). The elastic contact piece 21 is pressed firmly against the male terminal 30. As a result, the male terminals 30 and the elastic contact pieces 21 contact with each other at a desired contact pressure.

On inserting the slider 40 into the slide groove 14, the upper end of the operational portion 41 of the slider 40 moves into the flexure accepting space 17 located under the locking arm 16. If the connector 10 is "half-engaged" with the mating connector housing, the locking arm; being deflected into the flexure accepting space 17; will prevent the operational portion 41 of the slider 40 from full insertion. This indicates that the connector is not completely mated with the mating connector.

The following is a description of the contact pressure between the male and female terminals 30 and 20 caused when the male terminal 30 is inserted into the female terminal 20.

Figure 6A:
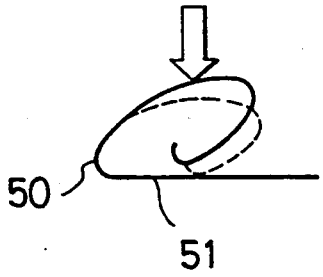
FIG. 6A and 6B show the female flexible contact piece with restrictive wall on the bottom and a single load being applied to the top of the piece, this can be associated with the load applied by the male contact piece.
Figure 6B:
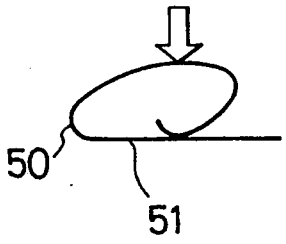

FIG. 6 and 7 show an elastic contact piece 50 and the elastic contact piece 21, respectively, according to the present embodiment. The elastic contact piece 50 is approximately equal in structure and in configuration to the elastic contact piece 21 as illustrated. The only difference between the two configuration is that the elastic contact piece 50 has a wall 51 which resists movement in the vertical direction.

Figure 7A:
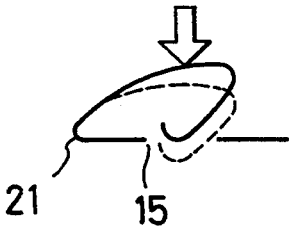
FIG. 7A and 7B show the female contact piece with a dual load, from top and bottom, this can be associated with the loads from the male contact piece from above and the load from the urging member from below.
Figure 7B:
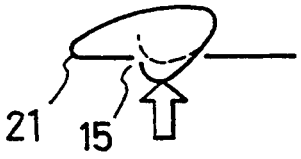

FIGS. 7A and 7B show the elastic contact portion according to the present embodiment. This elastic contact portion has no flexure restriction wall and the flexure accepting space 15 is provided adjacent with the side of the second curved portion 21*e*.

Figure 8A:
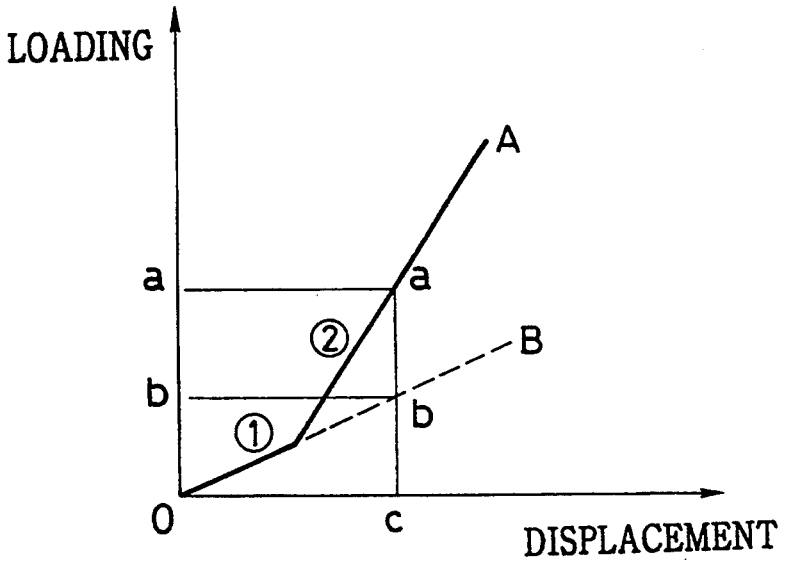
FIG. 8A shows loading as a function of insertion amount (displacement) when a male terminal is inserted into a female terminal.
Figure 8B:
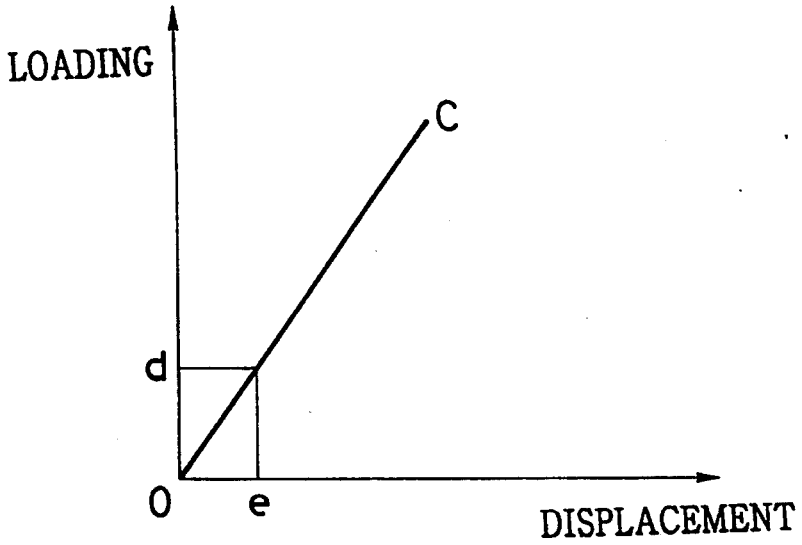
FIG. 8B shows loading as a function of displacement when an urging member is inserted into a guide groove.

For the purpose of comparison, the male terminals are inserted into the respective female terminals each of which has either one of these two kinds of elastic contact pieces 50 and 21. FIG. 8A shows contact loading as a function of displacement (insertion amount of the slider) when a male terminal is inserted into a female terminal and FIG. 8B shows displacement (insertion amount of the slider) as a function of contact loading when the slider 40 acts on the elastic contact piece 21 according to the present embodiment.

Using the elastic contact piece 50 as a comparative example, the contact loading indicated by "a" in FIG. 8, over a displacement "C", is caused when the male terminal is inserted into the female terminal. High insertion force is necessary due to this high loading vs. displacement relationship. This is because a cantilever spring as shown in FIG. 6A acts as if it is a center-spring, because of the restricting wall 51.

On the contrary, the elastic contact piece 21 of the present embodiment as shown in FIGS. 7A and 7B has no flexure restriction wall. Thus, it is left to be operated as the cantilever spring to yield the contact loading as indicated by "b", over a displacement "C". Accordingly, the difference between a and b corresponds to the difference between the loading of the cantilever spring and the center-spring. After completion of engagement of the male and female contacts, insertion of the slider into the slide groove causes a different loading as indicated by "d" in FIG. 8B, over a displacement "e". The value of d is equal to the value obtained by subtracting b from a, i.e., $a-b$, so that the resultant total loading is $b+d$ or $b+(a-b)$ which equals "a". The total loading obtained in the comparative example, as illustrated in FIG. 6, is equivalent to the loading "a". This means that the contact performance of this new connector design is equal to that of the comparative connector. However, the load vs. displacement relationship for the new design has a smaller value than that of the comparative connector, so there is a lower insertion force required. It is noted that the slider 40 is made of a resin having a small friction coefficient so that the force required to insert the slider is significantly low.

The elastic contact piece 50 with a restrictive wall 51 present (shown in FIG. 6) exhibits the characteristic curve of loading said indicated by "A"; while curves "B" and "C" show the loading of the elastic contact piece 21, where there is no restrictive wall 51, is an example of the performance of flexure accepting space 15. As apparent from the figure, only the contact loading of B is required for inserting the male terminal into the female terminal. In other words, the insertion force is relatively low addition, the contact loading applied is equivalent to the sum of B and C over a distance c and e, respectively, when the slider 40 is inserted into the slide groove 14 after mating the male and female terminals. Accordingly, it is possible to maintain a sufficient amount of contact pressure.

It should be understood that the present invention is not limited to the particular embodiment shown and described above, and various changes and modifications may be made without departing from the spirit and scope of the appended claims.

What is claimed is:

1. An electrical connector requiring low insertion force comprising:

a connector housing having a terminal accommodating chamber and a side wall; and a first terminal contained in the terminal accommodating chamber for engaging a second terminal of a mating connector to be engaged with the electrical connector, said first terminal having an elastic contact portion which is deflected towards one side having a slide-contact with the second terminal when the second terminal is inserted to engage with said first terminal;

wherein said connector housing has a wall defining a flexure accepting space which allows the elastic contact portion to be deflected and a guide groove communicating with the flexure accepting space;

said electrical connector further having an urging member inserted from said side wall into the guide groove through the flexure accepting space to urge the elastic contact portion towards the second terminal:

wherein said connector housing further includes a locking arm which is deflected during engagement of said electrical connector and said mating connector, and said locking arm is restored after a completion of the engagement to provide a locking state therebetween, said urging member preventing said locking arm from being deflected when it is inserted into the guide groove.

2. An electrical connector requiring low insertion force as claimed in claim 1, wherein the elastic contact portion is formed into a U-shape or a C-shape having one end integrally connected to said first terminal, the elastic contact portion comprising a first curved portion that slides on and contacts with the second terminal and a second curved portion that slides on and contacts with said urging member.

3. An electrical connector requiring low insertion force comprising:

a connector housing having a terminal accommodating chamber and a side wall; and a female terminal contained in the terminal accommodating chamber for engaging a male terminal of a mating connector to be engaged with the electrical connector, said female terminal having an elastic contact piece which is deflected towards one side having a slide-contact with the male terminal when the male terminal is inserted to engage with said female terminal;

wherein said connector housing has a partition wall defining a flexure accepting space which allows the elastic contact piece to be deflected and a guide groove communicating with the flexure accepting space;

said electrical connector further having a slider inserted from said side wall into the guide groove through the flexure accepting space to urge the elastic contact piece towards the male terminal:

wherein said connector housing further includes a locking arm which is deflected during engagement of said electrical connector and with said mating connector and said locking arm is restored after completion of the engagement to provide a locking state therebetween, said slider preventing said locking arm from being deflected when it is inserted into the guide groove.

4. An electrical connector requiring low insertion force as claimed in claim 3, wherein the elastic contact piece is formed into a U-shape or a C-shape having one end integrally connected to said female terminal, the elastic contact piece comprising a first curved portion which slides on and contacts with the male terminal and a second curved portion which slides on and contacts with said slider.

5. An electrical connector requiring low insertion force comprising:

a connector housing having multiple terminal accommodating chambers and a side wall; and multiple female terminals contained in the respective terminal accommodating chambers for engaging respective male terminals of a mating connector to be engaged with the electrical connector, each of the female terminals having an elastic contact piece which is deflected towards one side having a slide-contact with the corresponding male terminal when the male terminal is inserted to engage with the female terminal, one elastic contact piece opposing another elastic contact piece;

wherein said connector housing has a pair of partitions defining a flexure accepting space that allows the elastic contact pieces to be deflected and a guide groove communicated with the flexure accepting space, the flexure accepting space being defined between the elastic contact pieces;

said electrical connector further comprising a slider having a plate-like body and an operational portion integrally formed with the body, said slider being inserted into the guide groove through the flexure accepting space, thereby squeezing the opposed elastic contact pieces to urge the elastic contact pieces towards the respective male terminals.

6. An electrical connector requiring low insertion force as claimed in claim 5, wherein the elastic contact piece is formed into a U-shape or a C-shape having one end integrally connected to said female terminal, the elastic contact piece comprising a first curved portion that slides on and contacts with the male terminal and a second curved portion that slides on and contacts with said slider.

7. An electrical connector requiring low insertion force as claimed in claim 5, wherein said connector housing further comprises a locking arm which is deflected during engagement of said electrical connector and a mating connector, and said locking arm is restored after a completion of the engagement to provide a locking state, the locking arm defining a flexure accepting space between the locking arm and a body of the mating connector, said operational portion of said slider preventing the locking arm from being deflected into the flexure space when said slider is inserted into the guide groove.

* * * * *